US008286965B2

(12) United States Patent
Tamaoki

(10) Patent No.: US 8,286,965 B2
(45) Date of Patent: Oct. 16, 2012

(54) AUTOMATIC DOCUMENT FEEDER WITH JAM DETERMINATION CONTROL

(75) Inventor: Motokazu Tamaoki, Gifu (JP)

(73) Assignee: Ricoh Company, Ltd., Tokyo (JP)

( * ) Notice: Subject to any disclaimer, the term of this patent is extended or adjusted under 35 U.S.C. 154(b) by 608 days.

(21) Appl. No.: 12/457,486

(22) Filed: Jun. 12, 2009

(65) Prior Publication Data

US 2009/0317095 A1 Dec. 24, 2009

(30) Foreign Application Priority Data

Jun. 18, 2008 (JP) ..... 2008-159487

(51) Int. Cl.
*B65H 7/02* (2006.01)

(52) U.S. Cl. ..... 271/258.01; 271/3.14; 399/21; 399/370

(58) Field of Classification Search ..... 271/258.01, 271/265.01, 3.14; 399/21, 370, 376
See application file for complete search history.

(56) References Cited

U.S. PATENT DOCUMENTS

| | | | | |
|---|---|---|---|---|
| 5,485,247 | A * | 1/1996 | Morishita et al. | 399/16 |
| 5,708,910 | A * | 1/1998 | Fukano et al. | 399/21 |
| 7,024,124 | B2 * | 4/2006 | Taguchi et al. | 399/21 |
| 7,775,519 | B2 * | 8/2010 | Takahashi et al. | 271/258.01 |

FOREIGN PATENT DOCUMENTS

| | | |
|---|---|---|
| JP | 06-227702 | 8/1994 |
| JP | 2003-54786 | 2/2003 |

OTHER PUBLICATIONS

Office Action mailed Jul. 3, 2012, for corresponding Japanese Patent Application No. 2008-159487.

* cited by examiner

*Primary Examiner* — Jeremy R Severson
(74) *Attorney, Agent, or Firm* — Harness, Dickey & Pierce, P.L.C.

(57) ABSTRACT

An automatic document feeder includes a controller that compares an input original length that is received from a main operating unit and an actual original length that is calculated based on a detection result from a registration sensor arranged, on a conveying path, downstream of a separation feeding unit. The controller sets, when a result of the comparison indicates that the input original length and the actual original length are not equal, a larger value between the input original length and the actual original length as a jam determining value. The controller controls a jam detection based on the set jam determining value.

9 Claims, 6 Drawing Sheets

AUTOMATIC DOCUMENT FEEDER WITH JAM DETERMINATION CONTROL

CROSS-REFERENCE TO RELATED APPLICATIONS

The present application claims priority to and incorporates by reference the entire contents of Japanese Patent Application laid-open No. 2008-159487 filed in Japan on Jun. 18, 2008.

BACKGROUND OF THE INVENTION

1. Field of the Invention

The present invention relates to an automatic document feeder and, more particularly, to an automatic document feeder used in an image forming apparatus.

2. Description of the Related Art

A typical automatic document feeder (ADF) that is used in an image forming apparatus, such as a facsimile machine, a copying machine, and a multifunction product (MFP), includes a paper feed tray on which a plurality of originals can be placed. A set of originals is picked up one by one from the paper feed tray, conveyed to an image scanning position, and then discharged to a discharge tray.

The typical ADF detects a jam that occurs on a conveying path between the paper feed tray and the discharge tray to protect the original.

To determine a jam, the typical ADF calculates an original length from an original size received via a control panel (hereinafter, "input original length") and sets the input original length as a jam determining value. The ADF calculates an original length using original detection sensors arranged on the conveying path (hereinafter, "actual original length"), and determines whether a jam occurs by comparing the actual original length with the jam determining value (see, for example, Japanese Patent Application Laid-open No. 2003-54786).

The ADF disclosed in the Japanese Patent Application Laid-open No. 2003-54786 compares the input original length received via the control panel of a main body of the image forming apparatus with an original length that is calculated based on a detection result from original length sensors arranged on a paper feed tray (hereinafter, "detected original length"), and sets a larger value between the input original length and the detected original length as the jam determining value. While the original is conveyed, the ADF measures a conveying amount of the original based on a detection result obtained from a registration sensor and a discharging sensor, thereby calculating the actual original length. When the actual original length is larger than the jam determining value, the ADF determines that the original has jammed. The ADF performs jam detection control by notifying the main body of the image forming apparatus of the jam and stopping motors, solenoids, or the like.

With this configuration, images are properly scanned even when a user fails to input a correct original size, in particular, when the user inputs a smaller value than the actual original length.

A way to determine timing to feed a next page of the originals (hereinafter, "subsequent-original feeding timing") based on the detected original length calculated according to information from the sensor arranged on the paper feed tray is known.

However, the ADF disclosed in the Japanese Patent Application Laid-open No. 2003-54786 requires a plurality of sensors for detecting the original size to be arranged on the paper feed tray. This disadvantageously makes the configuration of the ADF complicated and increases the cost of the ADF.

When detecting the maximum conveyable non-standard-size original, because an original length sensor for calculating the original length of this size has to be arranged, thus requiring the paper feed tray corresponding to the maximum conveyable original size. Accordingly, the size of the ADF becomes large.

Furthermore, other than the jam determining value, with the known ADF in which the subsequent-original feeding timing is determined based on the original length that is calculated based on the information from the sensor arranged on the paper feed tray, there is also a similar problem.

SUMMARY OF THE INVENTION

It is an object of the present invention to at least partially solve the problems in the conventional technology.

According to an aspect of the present invention, there is provided an automatic document feeder including a paper feed tray on which a plurality of originals can be placed; a separating unit that picks up originals one by one from the paper feed tray; a scanning unit that receives the originals from the separating unit and scans the originals one by one; a discharge tray on which the originals scanned by the scanning unit are discharged; an input unit with which size information indicative of a size of the originals placed on the paper feed tray is input; a detection unit that is arranged on a conveying path between the separating unit and the scanning unit and that detects actual size information indicative of an actual size of an original when the original is conveyed in the conveying path; a calculating unit that calculates a first original length from the size information and calculates a second original length from the actual size information; a comparing unit that compares the first original length with the second original length and outputs a result of comparison; a jam-determining-value setting unit that sets, when the result of comparison indicates that the first original length and the second original length are not equal, one of the first original length and the second original length as a jam determining value; and a control unit that performs jam determination control based on the jam determining value.

According to another aspect of the present invention, there is provided an automatic document feeder including a paper feed tray on which a plurality of originals can be placed; a separating unit that picks up originals one by one from the paper feed tray; a scanning unit that receives the originals from the separating unit and scans the originals one by one; a discharge tray on which the originals scanned by the scanning unit are discharged; an input unit with which size information indicative of a size of the originals placed on the paper feed tray is input; a detection unit that is arranged on a conveying path between the separating unit and the scanning unit and that detects actual size information indicative of an actual size of an original when the original is conveyed in the conveying path; a calculating unit that calculates a first original length from the size information and calculates a second original length from the actual size information; a comparing unit that compares the first original length with the second original length and outputs a result of comparison; a subsequent-original feed-timing-determining-value setting unit that sets, when the result of comparison indicates that the first original length and the second original length are not equal, one of the first original length and the second original length as a subsequent-original feed-timing-determining value; and a control unit that performs jam determination control based on the subsequent-original feed-timing-determining value.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

Figure 1:
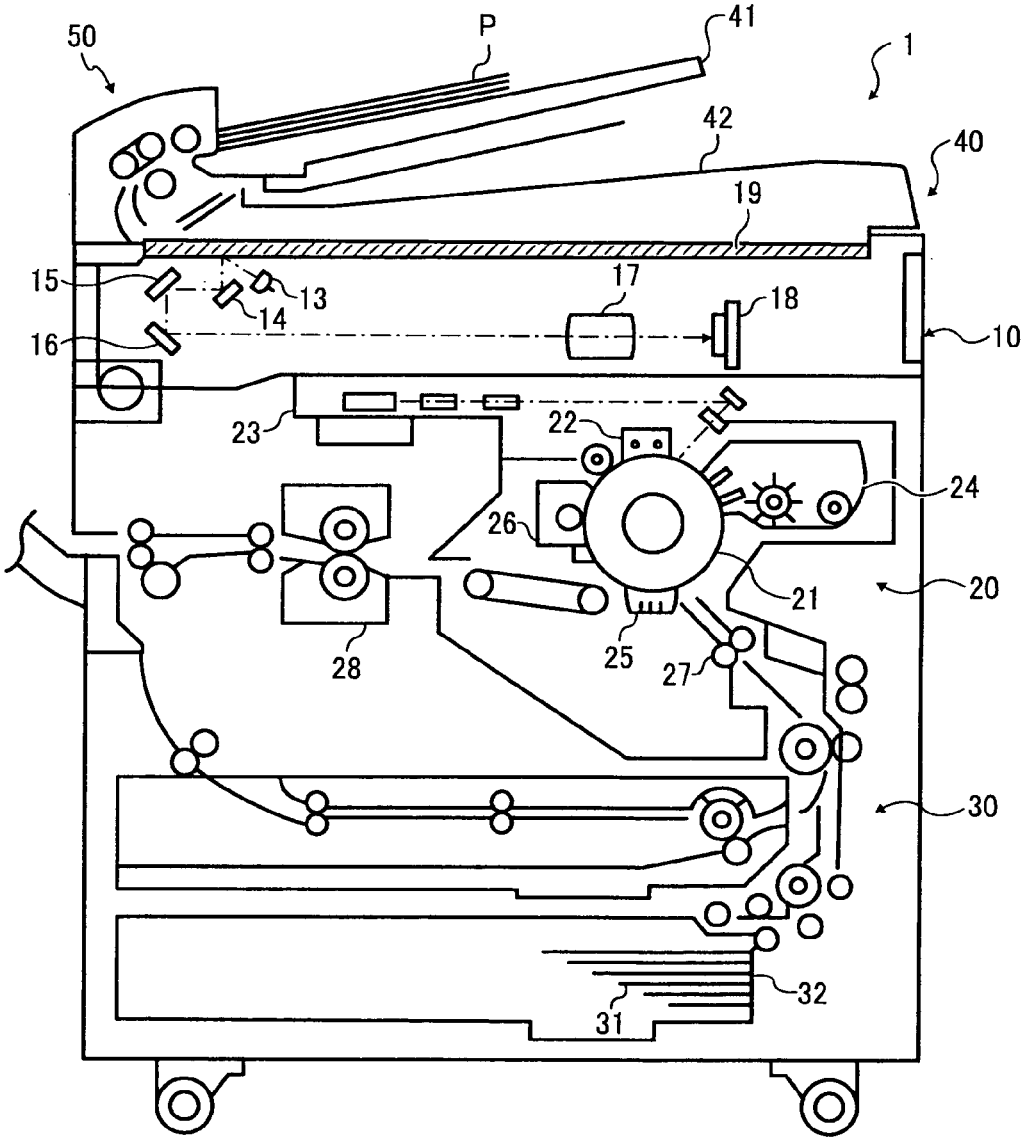
FIG. 1 is a schematic diagram of an internal structure of a copying machine including an ADF according to a first embodiment of the present invention.

FIG. 1 is a schematic diagram of an internal structure of a copying machine 1 including a sheet conveying unit according to a first embodiment of the present invention. A copying machine is an example of an image forming apparatus. The present invention can be applied to an image forming apparatus other than a copy machine such as a facsimile machine.

The configuration of the copying machine 1 is described below.

As shown in FIG. 1, the copying machine 1 includes a scanning unit 10; an image forming unit 20; a paper feeding unit 30, each accommodated in a main body of the copying machine 1; and an ADF 40 serving as the sheet conveying unit.

The ADF 40 feeds a set of originals placed on a paper feed tray 41 by picking up the originals one by one from the paper feed tray 41, conveys the originals to an image scanning position 12 (see FIG. 2), and discharges the conveyed originals onto a discharge tray 42. The scanning unit 10 scans the originals passing on a slit glass 11 that is arranged near the image scanning position 12, thereby obtaining image data from the originals. The image forming unit 20 converts the image data obtained by the scanning unit 10 into an electrical signal, and forms the image on a recording sheet 31 that is fed from the paper feeding unit 30. The recording sheet 31 on which the image is formed is discharged out of the copying machine 1 as a copy.

The configuration of the units of the copying machine 1 is described below.

The scanning unit 10 includes a first carriage on which a light source 13 and a first mirror 14 are mounted; a second carriage on which a second mirror 15 and a third mirror 16 are mounted; an imaging lens 17; and an optical system including an image capturing unit 18 formed of, for example, a charge-coupled device (CCD).

A scanning process in which the scanning unit 10 scans the original that is fed by the ADF 40 is as follows. The first carriage and the second carriage are stopped below the slit glass 11 (see FIG. 2). The light source 13 mounted on the first carriage irradiates the original passing on the slit glass 11 with light. The light is reflected from the original to the first mirror 14 that is mounted on the first carriage. The reflected light is further reflected from the first mirror 14 to the imaging lens 17 passed through the second mirror 15 and the third mirror 16 that are mounted on the second carriage. The reflected light is imaged by the imaging lens 17, and the image is scanned by the image capturing unit 18.

A scanning process in which the scanning unit 10 scans the original placed on an exposure glass 19 that is larger than the slit glass 11 is as follows. The first carriage and the second carriage are moved in the right-and-left direction in the plane of the paper of FIG. 1, i.e., in a sub-scanning direction, below the exposure glass 19. The light source 13 mounted on the first carriage irradiates the original placed on the exposure glass 19 with light. The light is reflected from the original to the first mirror 14 that is mounted on the first carriage. The reflected light is further reflected from the first mirror 14, the second mirror 15 and the third mirror 16 that are mounted on the second carriage so as to reach the imaging lens 17. The reflected light is focused by the imaging lens 17 on the image capturing unit 18 whereby an image of the original is formed on the image capturing unit 18.

The image forming unit 20 includes a photosensitive element 21; a charging unit 22; a writing unit 23 that exposes the photosensitive element 21 with light; a developing unit 24; a transfer unit 25 to which the recording sheet 31 is conveyed; and a cleaning unit 26 that cleans a surface of the photosensitive element 21. The charging unit 22, the writing unit 23, the developing unit 24, the transfer unit 25, and the cleaning unit 26 are arranged around the photosensitive element 21. The image forming unit 20 also includes various units, such as a main operating unit 108 (see FIG. 3) equipped with a touch panel or a numeric keypad. The image forming unit 20 corresponds to an image forming unit.

In the image forming unit 20, to form the image obtained by the image capturing unit 18, those units around the photosensitive element 21 operates as follows with the photosensitive element 21 rotating clockwise. First, the charging unit 22 charges the photosensitive element 21 uniformly. The writing unit 23 then exposes the photosensitive element 21 with light. A portion of the photosensitive element 21 exposed with the light is discharged, and thereby a latent image is formed on the photosensitive element 21. After that, the developing unit 24 develops the latent image with toner, thereby forming a visible toner image on the photosensitive element 21.

A registration roller 27 is driven in synchronization with the image forming process in such a manner that the recording sheet 31 is conveyed to the transfer unit 25 at proper timing. The transfer unit 25 transfers the toner image onto the recording sheet 31. After that, the toner image is fused on the recording sheet 31 by a fusing unit 28. The recording sheet 31 is then discharged as a copy out of the copying machine 1.

The paper feeding unit 30 includes a paper feed cassette 32 that stores therein the recording sheets 31 as a recording medium; and various rollers that convey the recording sheets 31 from the paper feed cassette 32 to a position where the image is formed in the image forming unit 20.

The image forming unit 20 and the paper feeding unit 30 feed the recording sheets 31, in advance, from the paper feed cassette 32 to a position just before the registration roller 27, based on information indicating whether the original to be scanned is on the paper feed tray (hereinafter, "subsequent original status") received from the ADF 40.

The ADF 40 includes the paper feed tray 41, the discharge tray 42, and a conveying unit 50 including various rollers. The conveying unit 50 conveys the originals from the paper feed tray 41 onto the slit glass 11. The original is scanned at the image scanning position 12 via the slit glass 11, and then discharged onto the discharge tray 42.

The ADF 40 is attached in such a manner that it can be opened and closed relative to the scanning unit 10 via an opening and closing mechanism (not shown).

A detailed description of the ADF 40 will be described later.

The copying operation of the copying machine 1 according to the first embodiment is described.

When the originals are set at the ADF 40, the ADF 40 detects the setting of the originals.

A user inputs an original size or a recording-sheet size with the main operating unit 108 equipped with, for example, a touch panel or a numeric keypad, and presses a print key or the like. The main operating unit 108 corresponds to an input unit. When the copying machine 1 starts the copying operation, the ADF 40 picks up the originals P one by one from the paper feed tray 41, and feeds the originals P toward the image scanning position 12 on the scanning unit 10. When the mode is selectable in which the recording-sheet size that is received via the main operating unit 108 is set as the original size, the user can select that mode and input the recording-sheet size or the original size.

The image of the original is scanned by an optical system in the scanning unit 10, and the obtained image is converted to the electrical signal. In the main body of the copying machine 1, the paper feeding unit 30 feeds the recording sheet 31 from the paper feed cassette 32 toward the registration roller 27.

In the image forming unit 20, with the exposure by the writing unit 23, the latent image is formed on the photosensitive element 21. The developing unit 24 develops the latent image with the toner, thereby forming the visible toner image.

The registration roller 27 is driven in synchronization with the image forming process. The toner image is transferred onto the recording sheet 31 that is conveyed to the transfer unit 25. The toner image is fused on the recording sheet 31 in the fusing unit 28. The recording sheet 31 is then discharged out of the copying machine 1 as the copy.

The ADF 40 informs about the subsequent original status. Based on the subsequent original status, the recording sheet 31 is fed out, in advance, from the paper feed cassette 32 to a position just before the registration roller 27.

A detailed description of the ADF 40 is described with reference to FIGS. 2 and 3.

Figure 2:
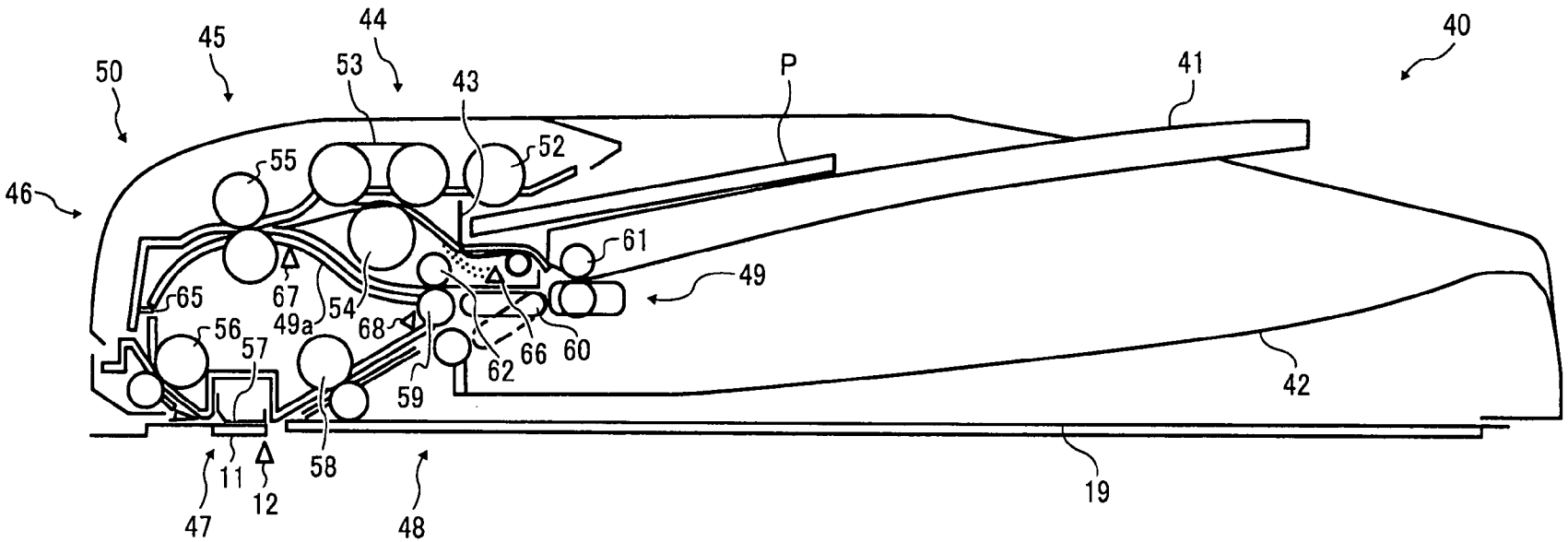
FIG. 2 is a schematic diagram of an internal structure of the ADF illustrated in FIG. 1.

FIG. 2 is a schematic diagram of the ADF 40. FIG. 3 is a block diagram of control configuration of the ADF 40.

The configuration of the ADF 40 is described below.

As shown in FIG. 2, the ADF 40 includes the paper feed tray 41. The originals P are placed on the paper feed tray 41 in such a manner that surfaces to be scanned (hereinafter, "front surfaces") are placed upward.

A set filler (not shown) that rotates in response to receiving the original is arranged at the front end of the paper feed tray 41 in the paper feeding direction. An original setting sensor 66 that detects whether the originals are placed on the paper feed tray 41 is arranged at the lowest portion, within a moving range, of the front end of the set filler. Specifically, when the originals are set on the paper feed tray 41, the set filler rotates, and the front end of the set filler departs from the original setting sensor 66, allowing the original setting sensor 66 to detect that the originals are placed.

A stopper claw 43 is arranged downstream of a conveying path of the originals. The stopper claw 43 moves between an abutting position, i.e., a position indicated by a solid line, and a retract position, i.e., a position indicated by a broken line, by a paper feeding solenoid 74, which is described later (see FIG. 3). The front end of the original P abuts against the stopper claw 43 at the abutting position. The stopper claw 43 retracts from the front end of the original P at the retract position.

Accordingly, when the stopper claw 43 is located at the abutting position, the front end of the original P abuts against the stopper claw 43 to be aligned. In addition, the original P in the width direction, i.e., a direction orthogonal to the conveying direction of the original, is aligned by abutting against a side fence (not shown) arranged on the paper feed tray 41.

The conveying unit 50 in the ADF 40 includes a separation feeding unit 44, a pull-out unit 45, a turning unit 46, a scan conveying unit 47, a discharging unit 48, and a switch-back unit 49.

The separation feeding unit 44 includes a calling roller 52, serving as a calling unit, arranged above the stopper claw 43; a paper feeding belt 53; and a reverse roller 54. The paper feeding belt 53 and the reverse roller 54 are opposed to each other across the conveying path. The calling roller 52 is raised and lowered between a position where the calling roller 52 retracts from the original P and a position where the calling roller 52 comes in contact with the upper surface of the original P by the paper feeding solenoid 74 (see FIG. 3).

The paper feeding belt 53 rotates in the paper feeding direction (clockwise direction). The reverse roller 54 rotates in a direction reverse to the paper feeding direction. When two or more originals are fed at one time, the reverse roller 54 reversely rotates with respect to the rotation of the paper feeding belt 53. When the reverse roller 54 is in contact with the paper feeding belt 53, or when only one original is conveyed, the reverse roller 54 is rotated in association with the paper feeding belt 53 by operation of a torque limiter (not shown).

The calling roller 52 contacts the top original of the set of originals placed on the paper feed tray 41, so that the separation feeding unit 44 feeds out the original toward a feeding port where the original is to be fed. When two or more originals are fed out at one time, the paper feeding belt 53 and the reverse roller 54 separate the originals to feed the originals one by one.

The pull-out unit 45 includes an abutting sensor 67 and a pair of pull-out rollers 55 that are arranged to be opposed each other across the conveying path. The pull-out unit 45 performs a primary abutting alignment with respect to the original at timing of driving the pull-out rollers 55 and the calling roller 52, and conveys the aligned original downstream in the conveying direction. The abutting sensor 67 detects the front end of the original that is conveyed from the separation feeding unit 44.

The turning unit 46 is formed of a portion of the conveying path that curves from upstream toward downstream of the conveying path. The turning unit 46 includes a registration sensor 65 and a pair of scanning entrance rollers 56. The registration sensor 65 corresponds to a detection unit. By conveying the original, which is received from the pull-out unit 45, on the curved conveying path, the turning unit 46 turns the original. The scanning entrance rollers 56 further conveys the original up to near the slit glass 11, with the front surface of the original downward.

The registration sensor 65 detects the front end and the rear end of the original that is conveyed from the pull-out unit 45 to the scan conveying unit 47.

The scan conveying unit 47 includes a scanning guide member 57 and a pair of scanning exit rollers 58. The scanning guide member 57 is arranged to be opposed to the slit glass 11 across the conveying path. The scanning exit rollers 58 are formed of rollers, arranged to be opposed each other across the conveying path where the scanned original passes. In the scan conveying unit 47, the scanning guide member 57 guides the original that is conveyed up to near the slit glass 11 to convey the original, while the front surface of the original is made to contact the slit glass 11. The optical system in the scanning unit 10 scans the conveyed original at the image scanning position 12. The scanning exit rollers 58 further convey the scanned original toward downstream in the conveying direction.

The discharging unit 48 includes a pair of discharging rollers 59 and a discharging sensor 68, which are arranged near a discharging port. The discharging rollers 59 discharge the original conveyed by the scanning exit rollers 58 to the discharge tray 42. The discharging sensor 68 detects the rear end of the original that passes through the scanning exit rollers 58 and that is discharged to the discharge tray 42 through the discharging port.

The switch-back unit 49 includes a switching claw 60 arranged near the discharging port and a pair of reverse rollers 61. The switching claw 60 moves up and down between positions indicated by a broken line and a solid line. At the position indicated by the broken line, with a later-described reverse switching solenoid 75 illustrated in FIG. 3 being driven, the conveying path is switched to convey the original passing through the discharging rollers 59 toward the reverse rollers 61. At the position indicated by the solid line, which is a switch-back path 49*a*, the conveying path is switched to convey the original in the direction reverse to the conveying direction by the reverse rollers 61 toward the pull-out rollers 55. The reverse rollers 61 reversely convey the original to the switch-back path 49*a* so that the scanning unit 10 can scan a back surface that is opposed to the front surface.

The switch-back unit 49 conveys the original to be scanned, in a switchback manner, to the pull-out rollers 55 via the switching claw 60, the reverse rollers 61, and the switch-back path 49*a*.

The control configuration of the ADF 40 is described below.

Figure 3:
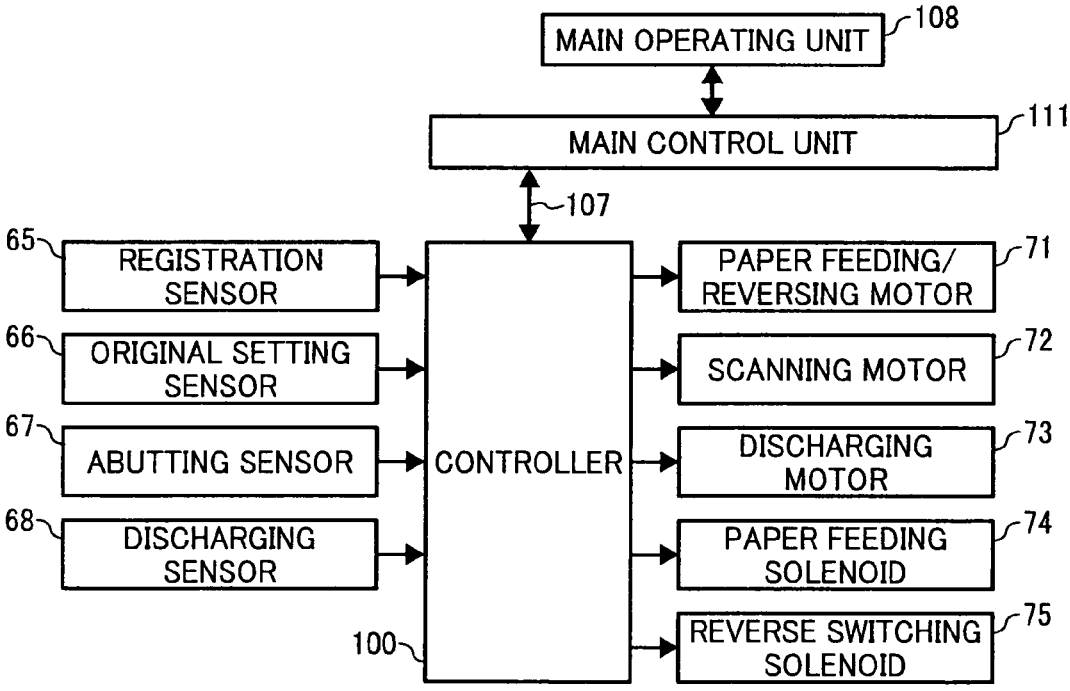
FIG. 3 is a block diagram of control configuration of the ADF according to the first embodiment.

As shown in FIG. 3, the ADF 40 includes a controller 100 that controls the ADF 40. The ADF 40 includes the registration sensor 65, the original setting sensor 66, the abutting sensor 67, and the discharging sensor 68. The sensors are connected to the controller 100 and they output detection signals to the controller 100.

The ADF 40 also includes a paper feeding/reversing motor 71, a scanning motor 72, a discharging motor 73, the paper feeding solenoid 74, and the reverse switching solenoid 75, serving as motors that control to drive the units in the ADF 40 in response to signals from the controller 100. The motors and the solenoids are connected to the controller 100.

The paper feeding/reversing motor 71 rotates the calling roller 52, the paper feeding belt 53, the reverse roller 54, the pull-out rollers 55, and the reverse rollers 61. The scanning motor 72 rotates the scanning entrance rollers 56 and the scanning exit rollers 58. The discharging motor 73 rotates the discharging rollers 59.

The paper feeding solenoid 74 raises and lowers the calling roller 52 between a position where the calling roller 52 retracts from the original P and a position where the calling roller 52 contacts the front surface of the original P. The paper feeding solenoid 74 also moves the stopper claw 43 between the abutting position and the retract position.

The reverse switching solenoid 75 raises and lowers the switching claw 60 between the positions indicated by the dotted line and the solid line in FIG. 2.

The controller 100 controls the motors and the solenoids based on the detection signals from the sensors.

The copying machine 1 includes a main control unit 111 that controls the copying machine 1 and the main operating unit 108. The main operating unit 108 performs various inputting operations, selecting operations, and operating instructions, with, for example, the touch panel or the numeric keypad. The main operating unit 108 corresponds to an input unit. The main operating unit 108 includes a display unit that displays input messages, operating instruction messages, and warning messages. The controller 100 and the main control unit 111 are connected via an interface (I/F) 107. Data, such as, control signal, is transferred to each other.

With the main operating unit 108, the user can directly input an original length with the touch panel or the numeric keypad to feed a non-standard size of the original using the ADF 40. The user can selectively input various standard sizes of the original, for example, A5, B5, A4, B4, and A3, with the touch panel or the numeric keypad to feed a standard size original.

With the main operating unit 108, the user can select a jam detection mode, which will be described later, and input a length (size) of a first page of the originals that are placed on the paper feed tray 41 with the touch panel or the numeric keypad.

Specifically, when the user presses, for example, a selection button of the touch panel, the main operating unit 108 selects either mode, i.e., a longer-original-length mode or an input-original-length mode as a jam detection mode. In the longer-original-length mode, a larger value, between an input original length and an actual original length, is set as a jam determining value. On the other hand, in the input-original-length mode, the original length input by the user is set as the jam determining value. The main operating unit 108 corresponds to a jam-detection-mode selecting unit.

The main operating unit 108 also includes a registration button. When the user presses the registration button, the selected jam detection mode is registered as an initial value for a jam detection control. The jam detection mode registered by the main operating unit 108 is stored in a nonvolatile memory (not shown) as the initial value for the jam detection control. The main operating unit 108 corresponds to a registering unit.

The main operating unit 108 sends various data received via the touch panel to the controller 100 via the I/F 107 before the ADF 40 feeds the original.

The operation in which the ADF 40 scans the original using a so-called sheet-through method is described.

When the original P is placed on the paper feed tray 41, the set filler and the original setting sensor 66 detect the placement of the original P, and send the detection signal to the main control unit 111 via the I/F 107. When the original setting sensor 66 detects the placement of the original P on the paper feed tray 41, by making the paper feeding solenoid 74 to absorb, the controller 100 lowers the calling roller 52 to the position where the original P contacts the calling roller 52 and downwardly retracts the stopper claw 43 from the original P. Accordingly, because the original P is pressed against the paper feed tray 41 at a predetermined pressure, the front end of the original P is released toward downstream in the conveying direction.

When the user places the original P on the paper feed tray 41 and presses the print key in the main operating unit 108 arranged in the main body of the copying machine 1, and when the main control unit 111 sends an original paper feeding signal to the controller 100 via the I/F 107, the operation of feeding the original starts.

At this time, by driving the paper feeding motor in the positive direction, the calling roller 52 starts to pick up the originals one by one, by the number of originals, ideally, a single original, placed on the paper feed tray 41. The fed original is conveyed to the paper feeding belt 53 and the reverse roller 54 in the separation feeding unit 44 arranged downstream of the calling roller 52. In other words, only the top original is fed at one time from the paper feed tray 41 by being separated from the next original.

Specifically, the reverse roller 54 contacts the paper feeding belt 53 at a predetermined pressure. The reverse roller 54 is configured in such a manner that, when the reverse roller 54 directly contacts the paper feeding belt 53, or when the reverse roller 54 contacts the paper feeding belt 53 via a single original, the reverse roller 54 rotates counterclockwise in synchronization with the paper feeding belt 53, whereas, when the paper feeding belt 53 and the reverse roller 54 receive two or more sheets of originals, a rotation force acting in synchronization with the paper feeding belt 53 is lower than a torque of the torque limiter. Accordingly, the reverse roller 54 rotates clockwise, i.e., the original driving direction, to push back excess originals, thus preventing double feeding.

The original that is picked up one by one is further conveyed by the paper feeding belt 53. The front end of the original is detected by the abutting sensor 67 arranged downstream of the paper feeding belt 53. When the detected original is conveyed by a predetermined amount X (millimeters) from a position where the front end of the original is detected by the abutting sensor 67, the controller 100 stops driving a positive rotation of the paper feeding/reversing motor 71.

The predetermined amount X is set larger than the distance from the abutting sensor 67 to a nip of the pull-out rollers 55. The original stops at the nip of the pull-out rollers 55 in a flexible manner to some extent.

At this time, with a command from the controller 100, the paper feeding solenoid 74 is turned OFF, thus the calling roller 52 retracting from the original. Because the original is conveyed by only a conveying force of the paper feeding belt 53, the front end of the original abuts against the nip of the pull-out rollers 55, thus correcting a bent (skew) caused when the original is conveyed one by one.

The original that is subjected to the skew correction by the reverse driving paper feeding/reversing motor 71, which is reversely driven, is conveyed, by the pull-out rollers 55, toward the scanning entrance rollers 56 arranged downstream of the conveying path via the turning unit 46 defining the curved conveying path. Thereafter, a conveying speed of the original is reduced before the original reaches the scanning entrance rollers 56.

The registration sensor 65 detects the front end of the original passing through the turning unit 46. At this time, the controller 100 performs a jam detection control, which will be described later. When the registration sensor 65 does not detect the front end of the original even though a certain amount of time has passed since the original is fed or the original is conveyed by a certain amount of distance or longer, the controller 100 determines that a jam has occurred and stops conveying the original.

The controller 100 calculates a driving amount or a driving time of the paper feeding/reversing motor 71 during the time from when the front end of the original is detected by the registration sensor 65 to when the rear end of the original passes the registration sensor 65. An original length is calculated from the calculated driving amount or the calculated driving time. The calculated original length is used as an actual original length of the second page and subsequent pages of the originals.

If the registration sensor 65 detects the front end of the original but does not detect the rear end of the original even when the certain amount of time has passed since the original is fed or the original is conveyed by the certain amount of distance or longer, the controller 100 determines that a jam has occurred. This process is the jam detection control. With the jam detection control, the controller 100 determines whether a jam has occurred by comparing a distance by which the original is conveyed (hereinafter, "conveying distance") with the jam determining value that is set based on the later-described original length information. The conveying distance is calculated from the driving amount or the driving time of the paper feeding/reversing motor 71. When the controller 100 determines that the jam has occurred, the controller 100 performs a series of controls to stop conveying the original. Specifically, when a result of comparison between the conveying distance and the jam determining value indicates that the conveying distance is larger than the jam determining value, the controller 100 determines that a jam has occurred. The controller 100 informs the main control unit 111 of the occurrence of jam, and stops the motors and the solenoid, thus stopping conveying the original. The controller 100 corresponds to a control unit.

The controller 100 determines whether the rear end of the original passes through the separation feeding unit 44 by comparing the conveying distance with the original length information. The conveying distance is calculated based on the driving amount or the driving time of the paper feeding/reversing motor 71 after the registration sensor 65 detects the front end of the original. The original length information contains values calculated from the original size that is input or selected by, for example, the main operating unit 108. The determination can be given using the following Inequality (1):

$$L1 > L3 - L2 \quad (1)$$

where L1 is conveying distance calculated from the driving amount or the driving time of the paper feeding/reversing motor 71 after the registration sensor 65 detects the front end of the original; L2 is distance between the separation feeding unit 44 and the registration sensor 65; and L3 is original length information.

It is also possible to use a subsequent-original feeding-timing determining value, which is set in a later-described second embodiment of the present invention, as the original length information.

When the controller 100 determines that the rear end of the original conveyed by the separation feeding unit 44 passes through the separation feeding unit 44, the controller 100 further determines whether a subsequent original to be fed is on the paper feed tray 41, i.e., the subsequent-original feeding status, based on detection information from the original setting sensor 66. The controller 100 then sends the subsequent-original feeding status to the main control unit 111 via the I/F 107. Upon receiving the subsequent-original feeding status indicating that the subsequent original to be fed is on the paper feed tray 41, the main control unit 111 operates to feed the recording sheet in advance from the paper feed cassette 32 to a position just before the registration roller 27.

After the controller 100 determines, using Inequality (1), that the rear end of the original passes the separation feeding unit 44, the controller 100 determines, from the driving amount or the driving time of the paper feeding/reversing motor 71, whether the next original will be fed spaced enough from the preceding original. In this way, by conveying the subsequent page, spaced enough from the preceding page, the controller 100 performs a subsequent-original feeding control to start a subsequent original feeding operation.

The original conveyed from the pull-out rollers 55 pauses at the nip of the scanning entrance rollers 56. When the pull-out rollers 55 pauses at the nip of the scanning entrance rollers 56, the controller 100 sends a pause signal to the main control unit 111 via the I/F 107.

When receiving the pause signal, the main control unit 111 sends a scanning start signal to the controller 100. The controller 100 drives the scanning motor 72 to convey the original that was paused, at a conveying speed according to a scanning magnification. The scanning entrance rollers 56 convey the original to the image scanning position 12 to scan the original. The scanning exit rollers 58 further convey the scanned original.

In the scan conveying unit 47, the original passes between the slit glass 11 and the scanning guide member 57 that is arranged at a position opposed to the slit glass 11 at a certain interval. The image of the original is scanned by the optical system (see FIG. 1) arranged in the scanning unit 10, is converted into the electrical signal via the CCD in the optical system, and is then stored in the memory. The controller 100 sends to the main control unit 111 a gate signal that indicates an effective image range in the sub-scanning direction, at the timing when the front end of the original reaches the image scanning position 12 based on a pulse count from the scanning motor 72. The signal is usually sent until the rear end of the original leaves the image scanning position 12.

The original passing through the image scanning position 12 via the turning unit 46 is conveyed by the scanning exit rollers 58 and the discharging rollers 59, with the front and back surface of the original being reversed. After completion of a single-sided scanning or a double-sided scanning, the original is discharged to the discharge tray 42 without being conveyed to the switch-back unit 49.

To convey the back surface of the original for double-sided scanning, the reverse switching solenoid 75 switches the position of the switching claw 60 to the position indicated by the broken line before the front end of the original, passing through the image scanning position 12, reaches the discharging rollers 59. Accordingly, the original is conveyed to the reverse rollers 61. The original is conveyed until the rear end of the original passes the discharging rollers 59 based on a pulse count from the discharging sensor 68 and pauses at the switch-back unit 49.

When the original pauses at the switch-back unit 49, the controller 100 determines that the rear end of the original exits the discharging rollers 59. The controller 100 turns the reverse switching solenoid 75 OFF, and moves the switching claw 60 to a position indicated by the solid line illustrated in FIG. 2.

By reversely driving the paper feeding/reversing motor 71, the controller 100 drives the reverse rollers 61 to switchback the original toward the pull-out rollers 55.

The original, switched the conveying direction thereof into the reverse direction, is conveyed to the pull-out rollers 55 by a pair of reverse conveying rollers 62. The original is again conveyed to the scan conveying unit 47 via the pull-out unit 45 and the turning unit 46, and the image on the back surface of the original is scanned.

To collate pages of the original to be discharged, the original scanned on both side is again switched the conveying direction thereof into the reverse direction in the switch-back unit 49, and discharged to the discharge tray 42 without being scanned in the scan conveying unit 47.

The setting process in which the ADF 40 sets the jam determining value is described.

Figure 4:
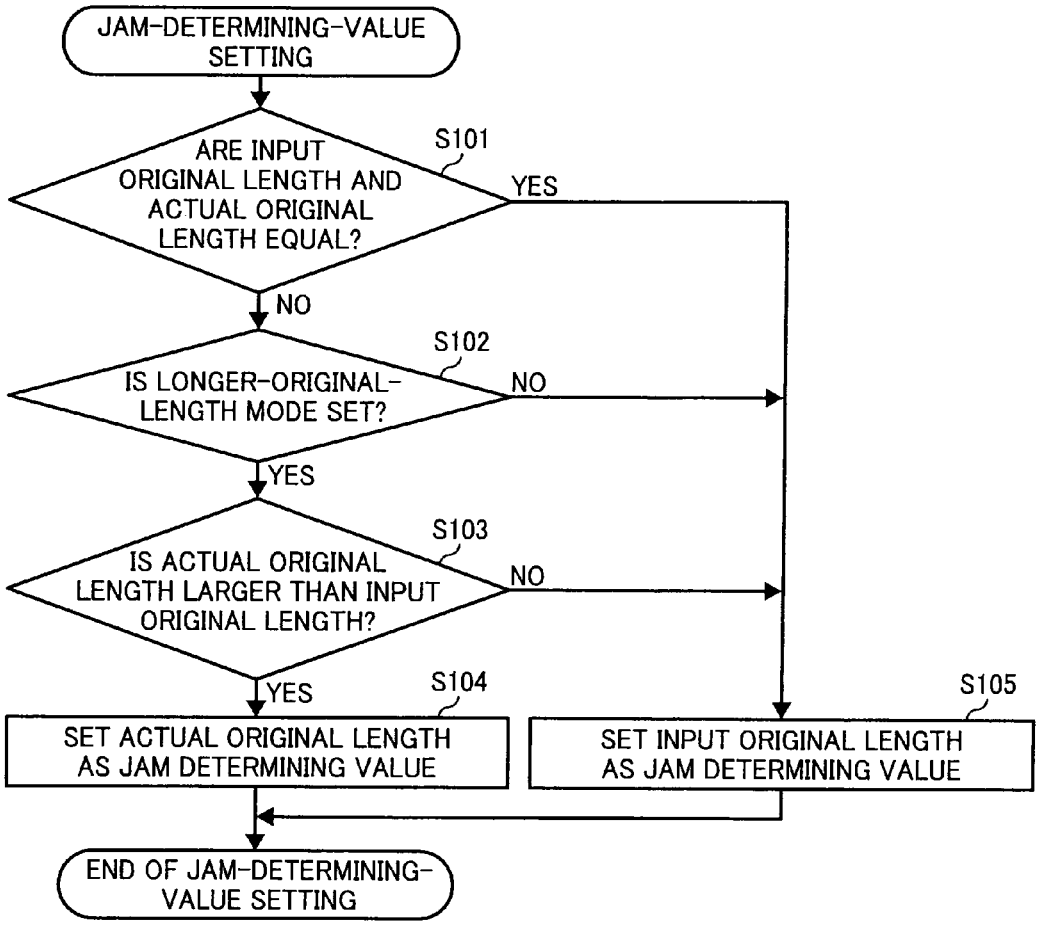
FIG. 4 is a flowchart of a process of setting a jam determining value according to the first embodiment.

FIG. 4 is a flowchart of a process in which the ADF 40 sets the jam determining value according to the first embodiment.

As shown in FIG. 4, before the ADF 40 starts paper feeding, the controller 100 determines whether the input original length and the actual original length are equal. The input original length corresponds to a first original length that is input by the user with the numeric keypad or the like in the main operating unit 108. The controller 100 compares the input original length with the actual original length (Step S101). The controller 100 corresponds to the comparing unit.

In the first embodiment, the actual original length is compared with the input original length that is input via the numeric keypad arranged in the main operating unit 108; however, the configuration is not limited thereto. For example, the actual original length can be compared with the original length that is calculated from the input original size selected via the touch panel in the main operating unit 108. In this case, the original length calculated from the input original size is the one calculated from a standard size parameter by referring to an original-length data table that is stored in the memory.

The actual original length of the second page and the subsequent pages of the originals to be fed is the length that is calculated based on the detection result from the registration sensor 65. The length of the first page of the originals is set in an original length setting process, which is described later. The actual original length corresponds to a second original length.

If the controller 100 determines that the input original length and the actual original length are equal (Yes at Step S101), the controller 100 sets the input original length as a jam determining value (Step S105).

If the controller 100 determines that the input original length and the actual original length are not equal (No at Step S101), the controller 100 determines whether a longer-original-length mode is set (Step S102). In the longer-original-length mode, a larger value between the input original length and the actual original length is set as a jam determining value, which corresponds to a first jam detection mode selected by the main operating unit 108. If the controller 100 determines that the longer-original-length mode, i.e., the first jam detection mode is not set (No at Step S102), the controller 100 determines that an input-original-length mode is set and then sets the input original length as the jam determining value (Step S105). The input-original-length mode corresponds to a second jam detection mode selected by the main operating unit 108.

When the longer-original-length mode, i.e., the first jam detection mode is set (Yes at Step S102), the controller 100 compares the input original length with the actual original length, and then determines whether the input original length is larger than the actual original length (Step S103). If the controller 100 determines that the actual original length is larger than the input original length (Yes at Step S103), the controller 100 sets the actual original length as the jam determining value (Step S104).

If the controller 100 determines that the input original length is larger than the actual original length (No at Step S103), the controller 100 sets the input original length as the jam determining value (Step S105).

By comparing the input original length with the actual original length in this way, when a result of comparison indicates that the input original length and the actual original length are not equal, the controller 100 sets a larger value as the jam determining value. The controller 100 corresponds to a jam-determining-value setting unit.

The controller 100 then performs the jam detection control based on the jam determining value that is set in the jam-determining-value setting process.

When setting the jam determining value, the actual original length of the second page and the subsequent pages, which is compared with the input original length, can be calculated based on the detection result from the registration sensor 65. However, when conveying the first page, the actual original length cannot be obtained because the registration sensor 65 does not issue a detection result.

Accordingly, the original length selected by the main operating unit 108 in the following manner is used as the actual original length of the first page.

Figure 5:
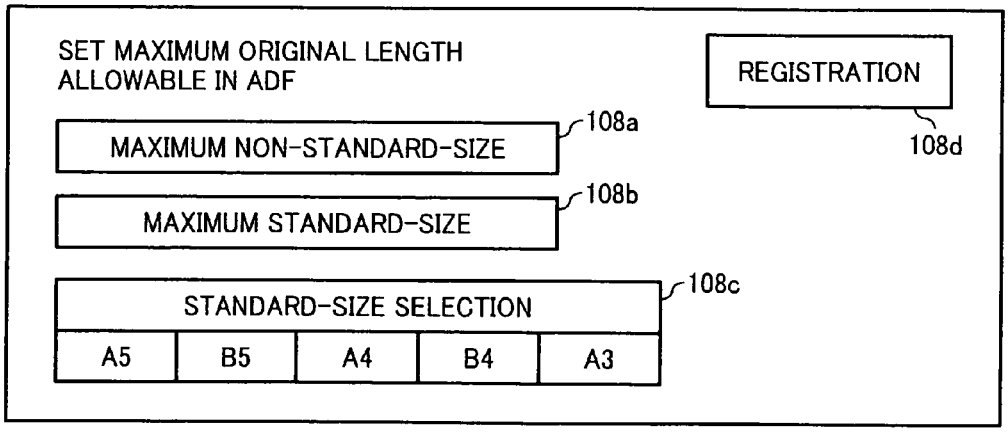
FIG. 5 is a schematic diagram of a touch panel display, for setting an original length, arranged in a main operating unit according to the first embodiment.
Figure 6:
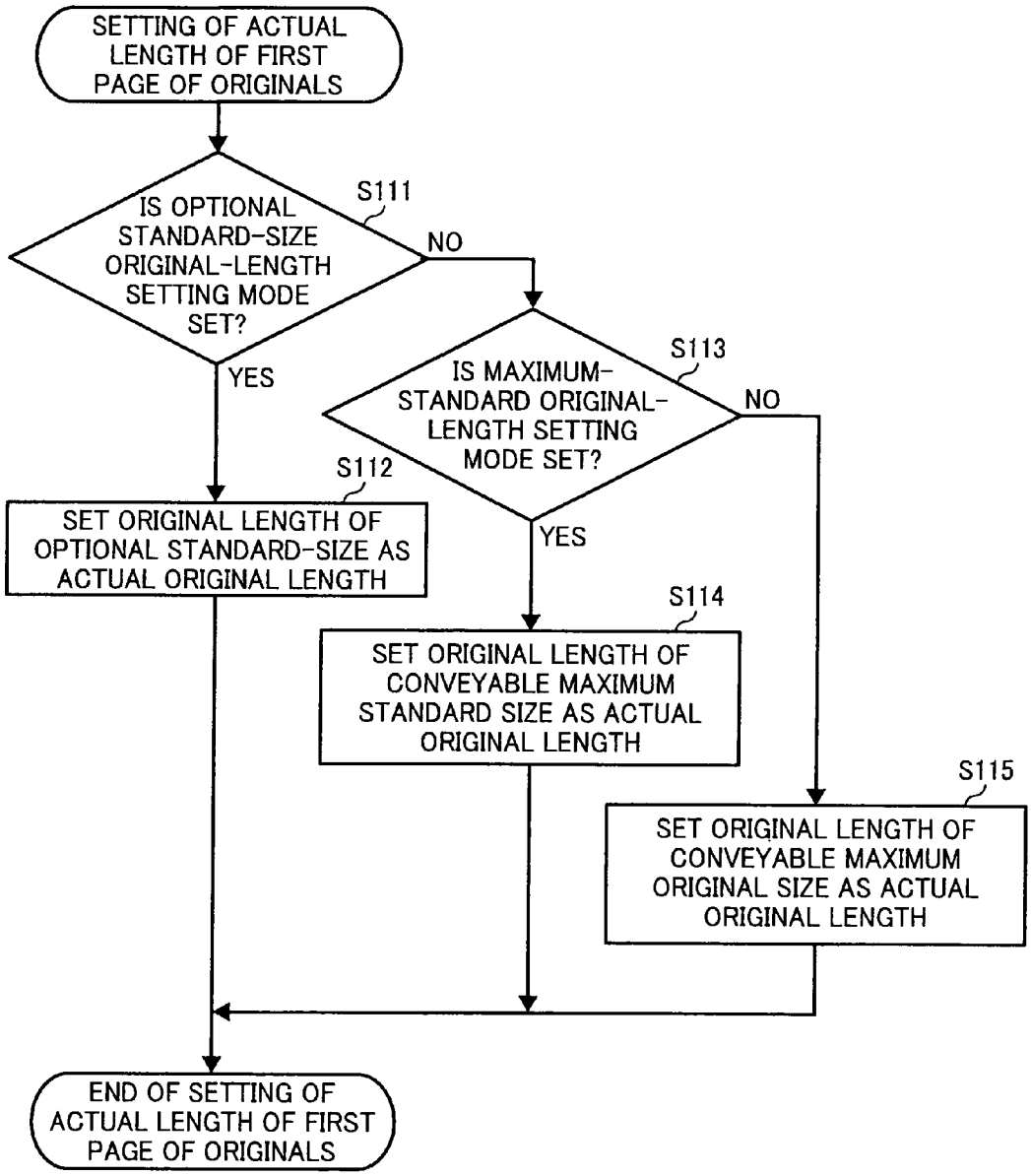
FIG. 6 is a flowchart of a process of setting a length of a first page of originals according to the first embodiment.

A setting of the length of the first page of the originals placed on the paper feed tray 41 is described with reference to FIGS. 5 and 6. FIG. 5 is a schematic diagram of a touch panel screen for setting the original length in the main operating unit 108. FIG. 6 is a flowchart of a process of setting the actual length of the first page of the originals.

As shown in FIG. 5, the touch panel screen for setting the original length in the main operating unit 108 includes a maximum non-standard-size button 108*a* in which the maximum original size allowable in the ADF 40 is set; a maximum standard-size button 108*b*; a standard-size selection display 108*c* including buttons indicating a plurality of standard sizes of the original, such as, A5, B5, A4, B5, and A3; and a registration button 108*d*.

When the user presses the maximum non-standard-size button 108*a*, the main operating unit 108 sets a later-described maximum original-length setting mode in which the length of the first page is set as a maximum length within an allowable range. When the user presses the maximum standard-size button 108*b*, the main operating unit 108 sets a later-described maximum-standard original-length setting mode in which the length of the first page is set as a length of a maximum standard size.

When the user selects one of the original size buttons on the standard-size selection display 108*c* and presses the selected original size button, the main operating unit 108 sets a later-described original-length setting mode in which the length of the first page is set as a length of the selected standard size.

The main operating unit 108 displays the touch panel screen for setting the original length in this way. The main operating unit 108 corresponds to an original-size selecting unit.

When the user presses the registration button 108*d*, the main operating unit 108 registers either one of the original length of the standard size selected via the standard-size selection display 108*c*, the maximum original length that is set in the maximum original-length setting mode, or a maximum standard original length that is set in the maximum-standard original-length setting mode in the memory as an initial value. The initial value is the value of the original length that is used for the jam detection control for the first page. The main operating unit 108 corresponds to a registering unit.

The operation of the original-length setting mode for the first page is described.

As shown in FIG. 5, when the user selects one of the original size buttons on the standard-size selection display 108*c* and presses the selected button to feed the first page of the originals, the original-length setting mode for the first page is set as the optional standard-size original-length setting mode. In other words, the user can select an optional standard size, from among the size of, for example, A5, B5, A4, B5, and A3, by selecting one of the original size buttons in the main operating unit 108. By pressing the registration button 108*d*, the user can also register the selected standard size in the memory as an initial value of the length of the first original of the originals used for the jam detection control.

The standard-size selection display 108*c* corresponds to the standard-size selection unit.

When the user presses the maximum standard-size button 108*b* to feed the first page of the originals, the original-length setting mode for the first page is set as the maximum-standard original-length setting mode. In other words, when the user presses the maximum standard-size button 108*b*, the size of the original to be fed is registered in the memory as a conveyable maximum standard size.

When the user presses the maximum non-standard-size button 108*a* to feed the first page of the originals, the original-length setting mode for the first page is set as the maximum original-length setting mode. In other words, when the user presses the maximum non-standard-size button 108*a*, the size of the original to be fed is registered in the memory as the conveyable maximum original size.

Each of the original lengths, i.e., the optional standard size, the maximum standard size, and the original size, is calculated from the original size parameters by referring to the original-length data table that is stored in the memory.

As described above, the main operating unit 108 can select the length of the first page of the originals to be fed from the paper feed tray 41 from among the conveyable maximum original size, the conveyable maximum standard size, and the standard size that is selected via the standard-size selection display 108*c*. Because the main operating unit 108 can select the length of the first page in this way, and because the original length selected by the main operating unit 108 is used as the actual original length, the user need not to directly input the original size with the main operating unit 108, thus improving operability for controlling of conveying the original.

After selecting the length of the first page of the originals, the main operating unit 108 sends the selected length of the first page to the controller 100 via the I/F 107.

A process of setting an actual length of the first page of the originals is described with reference to FIG. 6.

As shown in FIG. 6, the controller 100 determines whether the optional standard-size original-length setting mode is set for the first page of the originals (Step S111). Specifically, the controller 100 determines whether the optional standard size is selected by the standard-size selection display 108*c* (Step S111). When the controller 100 determines that the optional standard-size original-length setting mode is set (Yes at Step S111), the controller 100 sets the original length of the optional standard size as an actual original length of the first page of the originals (Step S112). For the first page of originals placed on the paper feed tray 41, the original length calculated from the standard size of the original selected via the standard-size selection display 108*c* is used for the actual original length. Therefore, the safety of the first page is improved when, for example, only originals having the standard size selected by the user are to be fed.

On the other hand, when the controller 100 determines that the optional standard-size original-length setting mode is not set (No at Step S111), the controller 100 determines whether the maximum-standard original-length setting mode is set for the first page (Step S113). Specifically, the controller 100 determines whether the conveyable maximum standard size is set by the maximum standard-size button 108*b* sets (Step S113). When the controller 100 determines that the maximum standard size is selected, the controller 100 sets the original length of the conveyable maximum standard size as the actual original length of the first page (Step S114). For the first page of the originals placed on the paper feed tray 41, the original length of the conveyable maximum standard size set in advance is used for the actual original length. Therefore, the safety of the first page is improved when, for example, only originals having the standard size are to be fed.

When neither the optional standard-size original-length setting mode nor the maximum-standard original-length setting mode are set, i.e., when the conveyable maximum original size is selected by the maximum non-standard-size button 108*a* to set the maximum original-length setting mode, the controller 100 sets the original length of the conveyable maximum original size as the actual original length of the first page (Step S115). For the first page of the originals placed on the paper feed tray 41, the original length of the conveyable maximum original set in advance is used for the actual original length. Therefore, the occurrence of unnecessary jam in the course of conveying the first page of the originals can be prevented even when, for example, the first page is a non-standard size.

In this manner, the controller 100 makes a jam determination using the actual original length that is set for the first page of the originals in the jam-determining-value setting process shown in FIG. 4.

In the first embodiment, the jam determining value is set based on the result of comparison between the input original length received from the main operating unit 108 and the actual original length based on the detection result of the original calculated by the registration sensor 65. However, the configuration is not limited thereto. For example, the subsequent-original feeding-timing determining value, which will be described in the second embodiment, can be set based on the result of comparison.

The controller 100 compares the actual original length calculated based on the detection result of the original received from the registration sensor 65 arranged, on the conveying path, downstream of the separation feeding unit 44 with the input original length received from the main operating unit 108. The controller 100 then sets, according to a result of comparison, a larger value between the input original length and the actual original length as the jam determining value based on the result of comparison. Accordingly, the allowable range of the jam determination becomes large. Even when the input original length and the actual original length are not equal, such as a case in which, for example, the user accidentally inputs a length smaller than the actual length to be conveyed, an unnecessary jam can be prevented, thus properly scanning the images.

The registration sensor 65 calculates the original length that is actually conveyed based on the detection result. Therefore, the jam detection control can be implemented with the simpler structure, as compared with the conventional technologies, without arranging the sensor on the paper feed tray 41 to detect the original size.

On the other hand, when the larger value is not set as the jam determining value, a value of the input original length is set as the jam determining value. Accordingly, even when the input original length and the actual original length that is actually conveyed are not equal, the jam detection control can be performed in such a manner that the user intends, thus preventing a decrease in the safety of the originals due to poor jam detection accuracy.

Furthermore, the configuration can be implemented without using the conventional paper feed tray as large as the maximum conveyable original length, thus downsizing the ADF.

The main operating unit 108 can select either the longer-original-length mode or the input-original-length mode. In the longer-original-length mode, the main operating unit 108 sets a larger value between the input original length and the actual original length as the jam determining value, whereas, in the input-original-length mode, the main operating unit 108 sets the input original length as the jam determining value. Accordingly, the jam detection control can be changed according to the degree of importance of the original to be conveyed. Specifically, the user decides which property is to be prior to the other, the safety of the originals of the original or the operability, according to the degree of importance of the original to be conveyed.

The registration button 108*d* can register one of the original lengths selected via the standard-size selection display 108*c*, the maximum non-standard-size button 108*a*, and the maximum standard-size button 108*b* as the initial value, for the first page of the originals and the jam detection mode, of the jam detection control. This simplifies operability for the user, which makes it possible to improve operability of the jam detection control. In addition, a subsequent-original feed-timing mode, which will be described later in the second embodiment, selected by the main operating unit 108 can be further registered as an initial value of the subsequent-original feeding control.

In the first embodiment, the controller 100 calculates the original length based on the detection result from the registration sensor 65; however, the configuration is not limited thereto. For example, the original length can also be calculated based on the detection result from the abutting sensor 67 or the discharging sensor 68.

Moreover, the main operating unit 108 formed of the touch panel or the numeric keypad is used to input or select various operations; however, the configuration is not limited thereto. For example, buttons, such as input buttons or selection buttons, arranged at other than the main operating unit 108 can be used.

The original length received from the main operating unit 108 and the original length calculated based on the detection result from the registration sensor 65 are compared, and a larger value between them is set as the jam determining value. However, the configuration is not limited thereto. For example, the larger value calculated in the same way can be set as the subsequent-original feeding-timing determining value, which will be described in the second embodiment.

Figure 7:
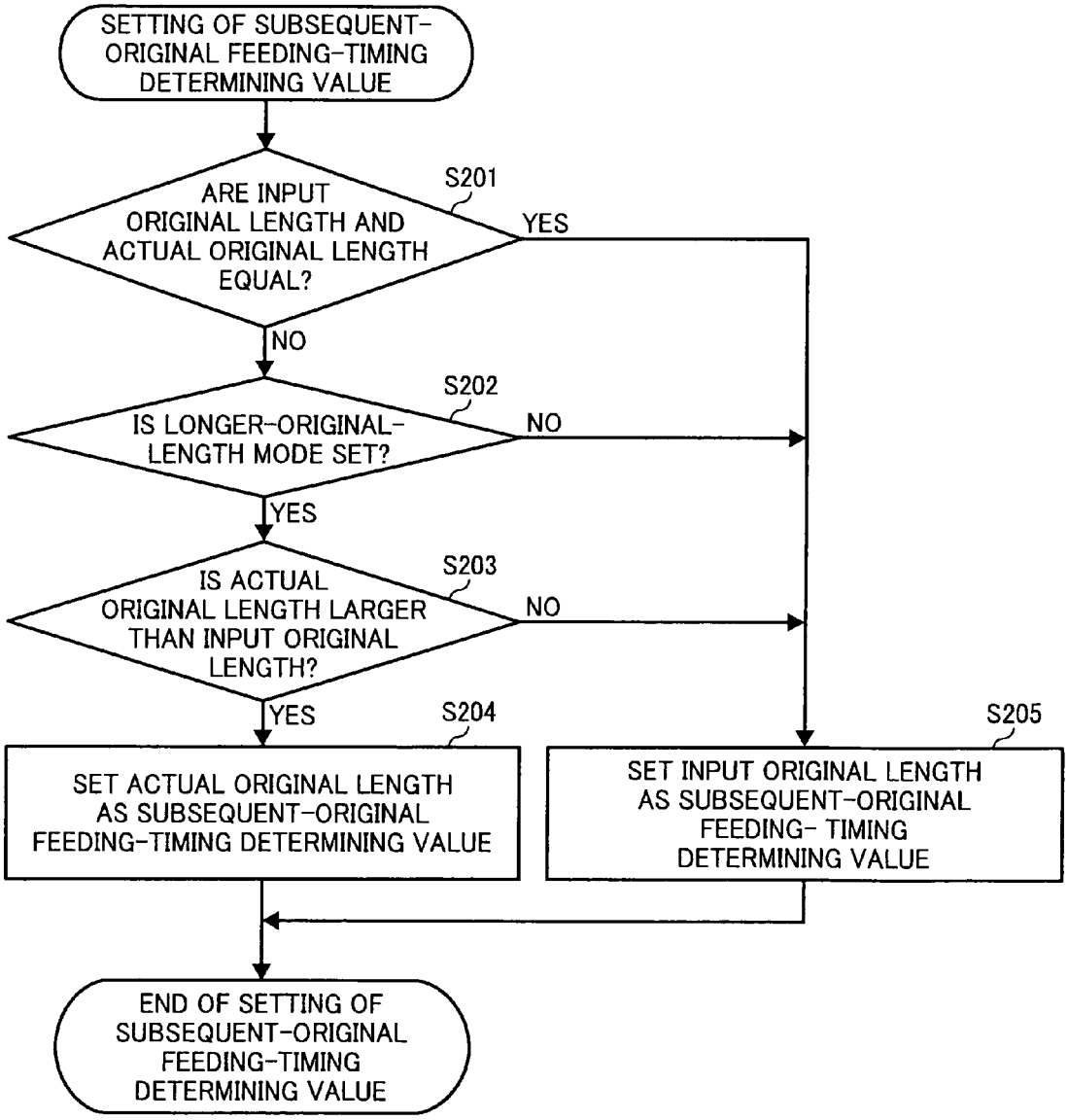
FIG. 7 is a flowchart of a process of setting a subsequent-original feeding-timing determining value according to a second embodiment of the present invention.

FIG. 7 is a flowchart of a process of setting a subsequent-original feeding-timing determining setting value according to the second embodiment. The configuration of the copying machine 1 in the second embodiment is substantially the same as that of the first embodiment. Therefore, components that are identical to the configuration in the first embodiment are assigned the same reference numerals, and only the differences are described in the second embodiment.

When the user operates the touch panel or the numeric keypad, the main operating unit 108 of the copying machine 1 selectively registers the length (size) of the first page of the originals placed on the paper feed tray 41 and the subsequent-original feed-timing mode.

Specifically, when the user operates, for example, the selection button at the touch panel, the main operating unit 108 can selects either mode, i.e., the longer-original-length mode or the input-original-length mode as the subsequent-original feed-timing mode. More specifically, in the second embodiment, the longer-original-length mode is a mode in which a larger value, between the input original length and the actual original length, is set as the subsequent-original feeding-timing determining value. The input-original-length mode is a mode in which the input original length is set as the subsequent-original feeding-timing determining value. The main operating unit 108 corresponds to a subsequent-original feed-timing-mode selecting unit.

The main operating unit 108 has the registration button 108*d*. When the user presses the registration button 108*d*, the main operating unit 108 registers the selected subsequent-original feed-timing mode as an initial value of the subsequent-original feeding control. The registered subsequent-original feed-timing mode is stored as the initial value of the subsequent-original feeding control in the nonvolatile memory. The main operating unit 108 corresponds to a registering unit.

A process in which the ADF 40 sets the subsequent-original feeding-timing determining value is described.

FIG. 7 is a flowchart of the process in which the ADF 40 sets the subsequent-original feeding-timing determining value according to the second embodiment.

As shown in FIG. 7, before the ADF 40 starts feeding the original, the controller 100 determines whether the input original length and the actual original length are equal (Step S201). In other words, the controller 100 compares the input original length that is input by the user via the numeric keypad or the like in the main operating unit 108 with the actual original length (Step S201). The controller 100 corresponds to a comparing unit.

In the second embodiment, the actual original length is compared with the original length that is input via the numeric keypad arranged in the main operating unit 108; however, the configuration is not limited thereto. For example, the actual original length can be compared with the original length that is calculated from the input original size selected via the touch panel in the main operating unit 108. In this case, the original length calculated from the input original size is the one calculated from the standard size parameters by referring to the original-length data table stored in the memory.

In the similar manner as in the first embodiment, the actual original length of the second page and the subsequent pages to be fed are calculated based on the detection result from the registration sensor 65. The actual original length of the first page is set in the original length setting process. The actual original length corresponds to the second original length.

When the controller 100 determines that the input original length and the actual original length are equal (Yes at Step S201), the controller 100 sets the input original length as the subsequent-original feeding-timing determining value (Step S205).

If the controller 100 determines that the input original length and the actual original length are not equal (No at Step S201), the controller 100 determines whether the longer-original-length mode is set (Step S202). In the longer-original-length mode, a larger value between the input original length and the actual original length is set as the subsequent-original feeding-timing determining value, which corresponds to a first subsequent-original feed-timing mode selected by the main operating unit 108. If the controller 100 determines that the longer-original-length mode, i.e., the first subsequent-original feed-timing mode is not set (No at Step S202), the controller 100 determines that the input-original-length mode is set, and then sets the input original length as the subsequent-original feeding-timing determining value (Step S205). The input-original-length mode corresponds to a second subsequent-original feed-timing mode set by the main operating unit 108.

When the longer-original-length mode, i.e., the first subsequent-original feed-timing mode is set (Yes at Step S202), the controller 100 compares the input original length and the actual original length and then determines whether the input original length is larger than the actual original length (Step S203). If the controller 100 determines that the actual original length is larger than the input original length (Yes at Step S203), the controller 100 sets the actual original length as the subsequent-original feeding-timing determining value (Step S204).

If the controller 100 determines that the input original length is larger than the actual original length (No at Step S202), the controller 100 sets the input original length as the subsequent-original feeding-timing determining value (Step S205).

By comparing the input original length and the actual original length in this way, when a result of comparison indicates that the input original length and the actual original length are not equal, the controller 100 sets a larger value between the two as the subsequent-original feeding-timing determining value. The controller 100 corresponds to a subsequent-original feeding-timing determining value setting unit.

Accordingly, the controller 100 can perform the subsequent-original feeding control, in the similar manner as in the first embodiment, based on the subsequent-original feeding-timing determining value that is set in the subsequent-original feeding-timing determining value setting process.

A setting of the length of the first page of the originals placed on the paper feed tray 41 according to the second embodiment is described.

When setting the subsequent-original feeding-timing determining value, in the similar manner as in the first embodiment, the actual original length of the second page and the subsequent pages, which is compared with the input original length, can be calculated based on the detection result from the registration sensor 65. However, when conveying the first page, the actual original length cannot be obtained because the registration sensor 65 does not issue the detection result.

Accordingly, by performing the process of setting the length of the first page of the originals as shown in FIGS. 5 and 6 in the same manner as in the first embodiment, the actual original length is set from among one of the selected original length of the optional standard size, the maximum conveyable standard size, and the maximum conveyable original size.

In this manner, in the subsequent-original feeding-timing determining value setting process shown in FIG. 7, the controller 100 determines the subsequent-original feeding timing for the first original based on the actual original length that is set in the above-described processing.

When the user presses the registration button 108*d*, the main operating unit 108 registers either one of the original length of the standard size selected via the standard-size selection display 108*c*, the maximum original length that is set as the maximum original-length setting mode, or the maximum standard original length that is set as the optional standard-size original-length setting mode in the memory as an initial value of a subsequent-original feeding control. The main operating unit 108 corresponds to a registering unit.

The subsequent-original feeding control is described below.

The controller 100 determines whether the rear end of the original passes through the separation feeding unit 44 by comparing the conveying distance with the original length information. The conveying distance is calculated based on the driving amount or the driving time of the paper feeding/reversing motor 71 after the registration sensor 65 detects the front end of the original. The original length information contains the subsequent-original feeding-timing determining value determined in the subsequent-original feeding-timing determining value setting process. The determination can be made from the following inequality (2):

$$L1>L3-L2 \quad (2)$$

where L1 is conveying distance calculated from the driving amount or the driving time of the paper feeding/reversing motor 71 after the registration sensor 65 detects the front end of the original; L2 is distance between the separation feeding unit 44 and the registration sensor 65; and L3 is original length information.

When the controller 100 determines that the rear end of the original conveyed by the separation feeding unit 44 passes through the separation feeding unit 44, the controller 100 further determines whether the subsequent original to be fed is on the paper feed tray 41, i.e., the subsequent-original feeding status, based on the detection information from the original setting sensor 66. The controller 100 then sends the subsequent-original feeding status to the main control unit 111 via the I/F 107. Upon receiving the subsequent-original feeding status indicating that the subsequent original to be fed is on the paper feed tray 41, the main control unit 111 operates to feed the recording sheet in advance from the paper feed cassette 32 to a position just before the registration roller 27.

After the controller 100 determines, using Inequality (2), that rear end of the original passes through the separation feeding unit 44, the controller 100 determines, from the driving amount or the driving time of the paper feeding/reversing motor 71, whether the next original will be fed spaced enough from the preceding original. In this way, by conveying the subsequent page, spaced enough from the preceding page, the controller 100 performs the subsequent-original feeding control to start the subsequent original feeding operation.

The controller 100 performs the subsequent-original feeding control based on the subsequent-original feeding-timing determining value that is set in the subsequent-original feeding-timing determining value setting process. The controller 100 corresponds to the control unit.

When the actual original length is shorter than that the original length indicated by the original length information, the registration sensor 65 will detect the rear end of the original at a timing before the original is expected, based on the original length information, to pass through the separation feeding unit 44. In this case, the determination of the subsequent-original feeding status and the operation of the subsequent-original feeding can start at timing when the registration sensor 65 detects the rear end of the original. On the other hand, when the original length to be conveyed can be expected in advance, it is possible to start the determination of the subsequent-original feeding status and the operation of the subsequent original feeding at a timing when the rear end of the original passes through the separation feeding unit 44 that is arranged upstream of the conveying path on which the registration sensor 65 is arranged. Accordingly, scanning performance of the original can be improved.

As described above, in the second embodiment, the controller 100 compares the actual original length calculated based on the detection result of the original received from the registration sensor 65 with the input original length received from the main operating unit 108. The controller 100 then sets, according to a result of comparison, a larger value between the input original length and the actual original length as the subsequent-original feeding-timing determining value. Accordingly, even when the input original length and the actual original length are not equal, such as a case in which, for example, the user accidentally inputs a length smaller than the actual length, the subsequent page is conveyed, spaced enough from the preceding page. This makes it possible to prevent a failure due to conveying the originals with mixed sizes.

On the other hand, when the larger value is not set as the subsequent-original feeding-timing determining value, the input original length is set as the subsequent-original feeding-timing determining value. Accordingly, even when the input original length and the actual original length are not equal, when conveying, for example, the set of single size originals, the subsequent page is conveyed, spaced enough from the preceding page, thus scanning performance of the original can be improved.

The registration sensor 65 calculates the original length that is actually conveyed based on the detection result. Therefore, the subsequent-original feeding control can be implemented with a simpler structure, as compared with the conventional technologies, without arranging the sensor on the paper feed tray 41 to detect the original size.

Because the configuration can be implemented without using the conventional paper feed tray whose size corresponds to the maximum conveyable original length, thus downsizing the ADF.

The main operating unit 108 can select the longer-original-length mode and the input-original-length mode. In the longer-original-length mode, a larger value between the input original length and the actual original length is set as the subsequent-original feeding-timing determining value. In the input-original-length mode, the input original length is set as the subsequent-original feeding-timing determining value. Accordingly, the user can choose conveying performance or scanning performance according to the type of the original placed on the paper feed tray 41. The high conveying performance will be required, when, for example, conveying the mixed size original, whereas, the high scanning performance will be required, when, for example, conveying the set of single size original.

In addition to the original length selected via the standard-size selection display 108*c*, the maximum non-standard-size button 108*a*, and the maximum standard-size button 108*b*, the subsequent-original feed-timing mode selected by the main operating unit 108 can be registered as the initial value, for the length of the first page of the originals, of the subsequent-original feeding control. This simplifies the user operation, which makes it possible to improve operability of the subsequent-original feeding control. In addition, the jam detection mode, described in the first embodiment, selected by the main operating unit 108 can be registered as the initial value of the jam detection control.

With this configuration, the allowable range of the jam determination becomes large. Even when the input original length and the actual original length are not equal, such as a case in which, for example, the user accidentally inputs a length smaller than the actual length to be conveyed, an unnecessary jam can be prevented, thus properly scanning the images.

Moreover, the jam detection control can be implemented with the simpler structure, as compared with the conventional technologies, without arranging the sensor on the paper feed tray 41 to detect the original size.

Furthermore, because it is unnecessary to use the paper feed tray as large as the maximum conveyable original length, it is possible to downsize the ADF.

Moreover, even when the input original length and the actual original length that is actually conveyed are not equal, the jam detection control can be performed in such a manner that the user intends, thus preventing a decrease in the safety of the originals due to poor jam detection accuracy.

Furthermore, the jam detection control can be changed according to the degree of importance of the original to be conveyed. Specifically, the user decides which property is to be prior to the other, the safety of the originals or the operability, according to the degree of importance of the original to be conveyed.

Moreover, even when the input original length and the actual original length are not equal, such as a case in which, for example, the user accidentally inputs a length smaller than the actual length, the subsequent page is conveyed, spaced enough from the preceding page. This makes it possible to prevent a failure due to conveying the originals with mixed sizes.

Furthermore, the subsequent original feeding control can be performed with a simple structure without arranging the sensor on the table, as used in the conventional technologies, to detect the original size.

Moreover, even when the input original length and the actual original length are not equal, when conveying, for example, a set of single size originals, the subsequent page is conveyed, spaced enough from the preceding page, thus scanning performance of the original can be improved.

Furthermore, the user can choose conveying performance or scanning performance according to the type of the original placed on the paper feed tray. The high conveying performance will be required, when, for example, conveying the mixed size original, whereas, the high scanning performance will be required, when, for example, conveying the set of single size original.

Moreover, the occurrence of unnecessary jam in the course of conveying the first page of the originals can be prevented even when, for example, the first page is a non-standard size.

Furthermore, the safety of the first page when, for example, only originals having the standard size are to be fed is improved.

Moreover, the safety of the first page when, for example, only originals having a standard size specified by the user are to be fed is improved.

Furthermore, the user does not need directly inputting the original size with the input unit, thus improving the operability for conveying control.

Moreover, this configuration simplifies the user operation, which makes it possible to improve the operability of the jam detection control and the subsequent-original feeding control.

According to an aspect of the present invention, an automatic document feeder is capable of performing a jam detection control or a subsequent-original feeding control without arranging a sensor on a paper feed tray to detect an original size.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An automatic document feeder comprising:

a paper feed tray on which a plurality of originals can be placed;

a separating unit that picks up originals one by one from the paper feed tray;

a scanning unit that receives the originals from the separating unit and scans the originals one by one;

a discharge tray on which the originals scanned by the scanning unit are discharged;

an input unit with which size information indicative of a size of the originals placed on the paper feed tray is input;

a detection unit that is arranged on a conveying path between the separating unit and the scanning unit and that detects actual size information indicative of an actual size of an original when the original is conveyed in the conveying path;

a calculating unit that calculates a first original length from the size information and calculates a second original length from the actual size information;

a comparing unit that compares the first original length with the second original length and outputs a result of comparison;

a jam-determining-value setting unit that sets, when the result of comparison indicates that the first original length and the second original length are not equal, one of the first original length and the second original length as a jam determining value; and a control unit that performs jam determination control based on the jam determining value.

2. The automatic document feeder according to claim 1, wherein the jam-determining-value setting unit sets, when the result of comparison indicates that the first original length and the second original length are not equal, a larger value between the first original length and the second original length as the jam determining value.

3. The automatic document feeder according to claim 1, wherein the jam-determining-value setting unit sets, when the result of comparison indicates that the first original length and the second original length are not equal, the first original length as the jam determining value.

4. The automatic document feeder according to claim 1, further comprising a jam-detection-mode selecting unit that selects a first jam detection mode in which a larger value between the first original length and the second original length is to be set as the jam determining value and a second jam detection mode in which the first original length is to be set as the jam determining value, wherein the jam-determining-value setting unit sets, when the result of comparison indicates that the first original length and the second original length are not equal, the jam determining value according to a result of selection in the jam-detection-mode selecting unit.

5. The automatic document feeder according to claim 4, further comprising:

a standard-size selecting unit that can select an optional standard size from among a plurality of standard sizes of originals that are fed from the paper feed tray;

an original-size selecting unit that selects the original length of a first page of the originals that is fed from the paper feed tray, from among an original length of a maximum conveyable original, an original length of a maximum conveyable standard size, and an original length of the standard size selected by the standard-size selecting unit; and a registering unit that registers at least one of the jam detection mode selected by the jam-detection-mode selecting unit, the standard size of the first page of the originals that is fed from the paper feed tray selected by the standard-size selecting unit, and the original length of the first original selected by the original-size selecting unit as an initial value that is to be used in the jam detection control.

6. The automatic document feeder according to claim 1, wherein when an original being conveyed in the conveying path is a first original from among the originals in the paper feed tray, the calculating unit uses a preset length of a maximum conveyable original as the second original length.

7. The automatic document feeder according to claim 1, wherein when an original being conveyed in the conveying path is a first original from among the originals in the paper feed tray, the calculating unit uses a preset size of a maximum conveyable standard-size original as the second original length.

8. The automatic document feeder according to claim 1, further comprising a standard-size selecting unit that can select an optional standard size from among a plurality of standard sizes of originals that are fed from the paper feed tray, wherein when an original being conveyed in the conveying path is a first original from among the originals in the paper feed tray, the calculating unit uses a length calculated from the standard size that is selected by the standard-size selecting unit as the second original length.

9. The automatic document feeder according to claim 1, further comprising an original-size selecting unit that selects the original length of a first page of the originals that is fed from the paper feed tray, from among an original length of a maximum conveyable original, an original length of a maximum conveyable standard size, and an original length of the standard size selected by the standard-size selecting unit, wherein when an original being conveyed in the conveying path is a first original from among the originals in the paper feed tray, the calculating unit uses the original length selected by the original-size selecting unit as the second original length.

* * * * *